US007242899B2

(12) United States Patent
Eichhorn et al.

(10) Patent No.: US 7,242,899 B2
(45) Date of Patent: Jul. 10, 2007

(54) COLLAR ASSEMBLY FOR PRINTER FUSING SYSTEM

(75) Inventors: Wade R. Eichhorn, Minneapolis, MN (US); Keith Murphy, Minneapolis, MN (US); Boris Avrushchenko, St. Louis Park, MN (US); Kristian G. Wyrobek, Minneapolis, MN (US); Richard M. Duda, Stillwater, MN (US)

(73) Assignee: 7-Sigma, Inc., Minneapolis, MN (US)

( * ) Notice: Subject to any disclaimer, the term of this patent is extended or adjusted under 35 U.S.C. 154(b) by 196 days.

(21) Appl. No.: 11/031,744

(22) Filed: Jan. 7, 2005

(65) Prior Publication Data

US 2006/0153606 A1 Jul. 13, 2006

(51) Int. Cl.
*G03G 15/20* (2006.01)
*F28F 5/02* (2006.01)

(52) U.S. Cl. ..... 399/330; 492/46; 219/216

(58) Field of Classification Search ..... 399/330; 492/46; 219/216
See application file for complete search history.

(56) References Cited

U.S. PATENT DOCUMENTS

| | | | | |
|---|---|---|---|---|
| 4,229,950 | A * | 10/1980 | Fessenden | 492/46 |
| 4,952,782 | A * | 8/1990 | Yokokawa et al. | 399/334 |
| 5,649,891 | A * | 7/1997 | Kass et al. | 492/46 |
| 5,659,848 | A * | 8/1997 | Jeon | 399/330 |
| 6,363,613 | B1 * | 4/2002 | Wolf et al. | 29/896.91 |
| 6,440,048 | B1 * | 8/2002 | Bleil et al. | 399/330 |
| 6,665,504 | B2 * | 12/2003 | Lee et al. | 399/330 |

* cited by examiner

*Primary Examiner*—Andrew H. Hirshfeld
*Assistant Examiner*—Timothy J Dole
(74) *Attorney, Agent, or Firm*—Patterson, Thuente, Skaar & Christensen, P.A.

(57) ABSTRACT

An apparatus and method for stabilizing a fuser in an imaging apparatus. The apparatus includes a hub having a body. The body comprises an outside diameter configured to be at least partially disposed inside an end of a fuser core. The apparatus also includes an elastomeric collar having an inside diameter, wherein the inside diameter is at least partially disposed over the outside diameter of the hub.

7 Claims, 10 Drawing Sheets

COLLAR ASSEMBLY FOR PRINTER FUSING SYSTEM

FIELD OF THE INVENTION

The present invention relates generally to fusing toner to print media. More particularly, the invention relates to an apparatus for minimizing the gap caused by thermal expansion of the fusing system members at operating temperatures.

BACKGROUND OF THE INVENTION

Electrophotographic image forming devices, such as laser printers, use toner particles to form a desired image on print media. The print media is often paper, although a wide variety of different print media may be employed. Once the toner is applied to the media, the media is advanced along a media path to a thermal fuser. In some image forming devices, the fuser includes a fuser roller and a mating pressure roller. As the media passes between the fuser roller and the pressure roller, the toner is fused to the media through a process using pressure and heat exceeding 300° F. (148° C.).

The interference area between the fuser roller and the pressure roller is often referred to as the nip. It is desirable to maintain a substantially uniform pressure in the nip. Uneven, or non-uniform pressure may result in degraded print quality, wrinkled print media, or other undesirable consequences. As a result, the various fusing assembly components should preferably be mated to close tolerances at room temperature and remain close at operating temperature so that wobble and chattering are minimized.

The fuser roller typically includes a metal core made of aluminum. A polymer coating may be applied to the surface of the core. The mating fusing assembly includes hub and collar. The fusing assembly components are commonly fabricated of a steel alloy and may also include drive members such as a steel key. A plastic collar or ring may also be placed on the hub or fuser roller. The plastic collar can be split at one end to expand with the fuser member upon which it is mounted.

As the imaging device heats from ambient temperature to operating temperatures exceeding 300° F. (148° C.), the components of the fusing assembly expand in relation to their respective coefficients of thermal expansion. The thermal expansion of the aluminum roller core is larger than the thermal expansion of the steel hub components. The thermal expansion of the plastic collar is significantly less than the thermal expansion of both the aluminum roller core and the steel hub components.

The differences in thermal expansion between the various components adversely affects the mechanical stability and operating life of the fuser components. As the imaging device heats to operating temperature, the inside diameter of the fuser roller becomes greater than the outside diameter of the mating components. As a result, a minute level of wobble and chatter can be observed as the fuser roller rotates. The instability of the fuser roller at operating speed and temperature can cause micro machining of the steel hub assembly, plastic collar, and the surfaces of the fuser roller core. Eventually, the instability caused by the gap between the fusing members at operating temperatures may cause catastrophic failure of the fuser roller, plastic collar, or hub assembly.

Therefore, a system and method for addressing these and other problems is needed.

SUMMARY OF THE INVENTION

The objective of the present invention is to provide an apparatus to reduce the fuser roll and hub/collar assembly wear and breakage when a fuser roll is maintained at its operating speed and temperature.

Another objective of the present invention is to provide an apparatus which reduces the instability and wobble of the fuser roll at its operating speed and temperature.

Another objective of the present invention is to provide an apparatus which compensates for the differences in the thermal expansion between different materials from which the fusing members are composed.

Yet another objective of the present invention is to provide an apparatus which reduces the micro machining wear due to the instabilities of wobble and chatter resulting from the differences in diameters at operating temperature due to the differences in thermal expansion of different materials from which the members are composed.

In one embodiment, the invention includes an apparatus for stabilizing a fuser in an imaging apparatus. The apparatus comprises a hub having a body. The body comprises an outside diameter configured to be at least partially disposed inside an end of a fuser core. The apparatus also includes an elastomeric collar having an inside diameter, wherein the inside diameter is at least partially disposed over the outside diameter of the hub.

In another embodiment, the invention includes a fusing apparatus useful in printing. The fusing apparatus includes a fuser roller having a first end, a second end, and an elongated shaft extending from the first end to the second end. The first end defines a first inner diameter and the second end defines a second inner diameter. A first collar is at least partially disposed on the first inner diameter of the first end. A second collar is at least partially disposed on the second inner diameter of the second end.

In yet another embodiment, the invention includes a method of stabilizing a fuser in an imaging apparatus. The method includes providing a hub having a body. The body comprises an outside diameter. The method also includes the steps of applying a chemical priming agent to a portion of the outside diameter and molding an elastomeric sleeve to a portion of the outside diameter.

The apparatus is useful for minimizing the gap between the fuser roller inner diameter and the hub/collar assembly outer diameter, upon which the fuser roll is mounted, operating at operational temperature. The apparatus also minimizes the gap between two cylindrical fusing members, made of dissimilar metals with differing thermal expansion ratios, where the inner and outer diameters expand differently at operating temperature, affecting the mating and operation of the fuser assembly.

The apparatus compensates for the heat expansion differences between adjoining fuser members at operating temperatures. The apparatus forms a close fit between the hub and the fuser roller adjoined at room temperature and minimizes movement between the hub and fuser roller. The assembly expands in thickness in proportion to temperature, and compensates for the difference between the thermal expansion of the outer and inner diameters of the hub and fuser roller. The collar assembly behaves as an energy absorbing member when the fuser roller member and the hub member, operating at operational temperature and speed, come to a stop. The collar assembly is fabricated of a material having the physical property of a low swell ratio when exposed to operating environments in which functional and non-functional polydimethylsiloxane oils are present. The collar assembly can be applied to or adhered to the surface of another fusing assembly member. The collar assembly can cover any part of the contact or mating surfaces between the hub and the fuser roller. Alternatively, the collar assembly can be molded to the surface of the hub or the fuser roller. The collar assembly may also have two or more keys affixed to the hub for the purpose of driving the fuser roller. Alternatively the fuser roller may have two or more key slots for the purpose of mating with the collar assembly.

DETAILED DESCRIPTION OF THE PREFERRED EMBODIMENTS

Figure 1:
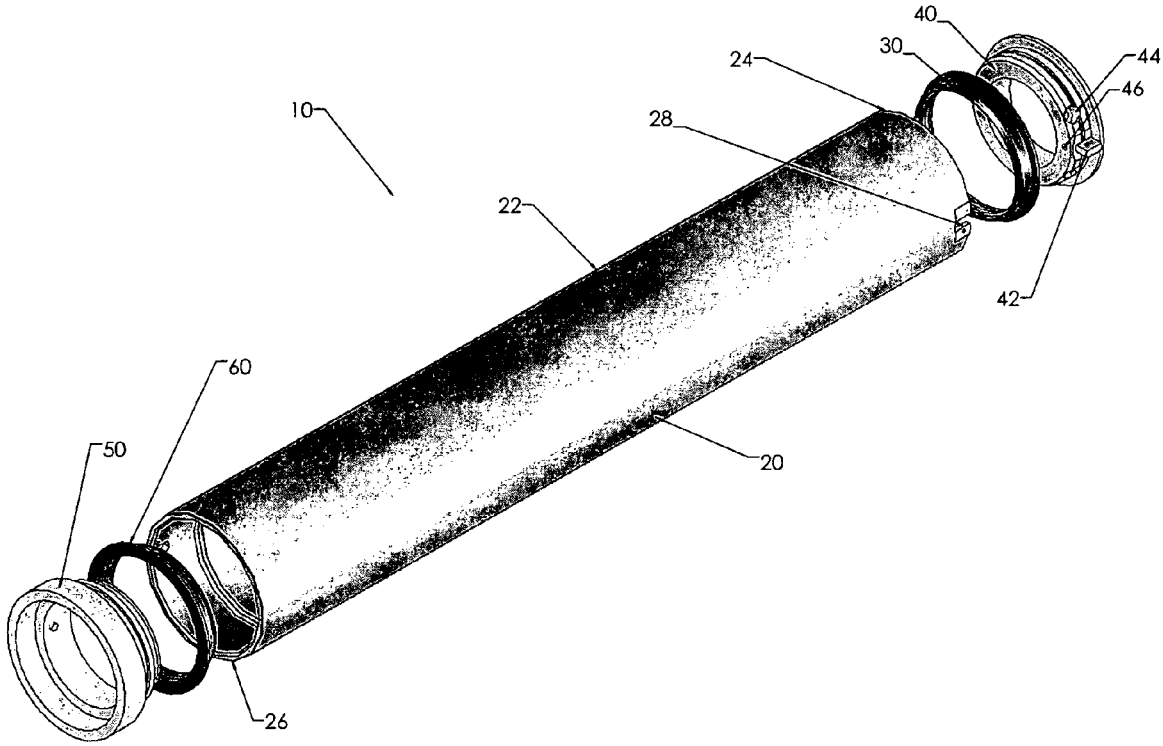
FIG. 1 shows an expanded isometric view of the fuser assembly in accordance with the present invention.
Figure 2:
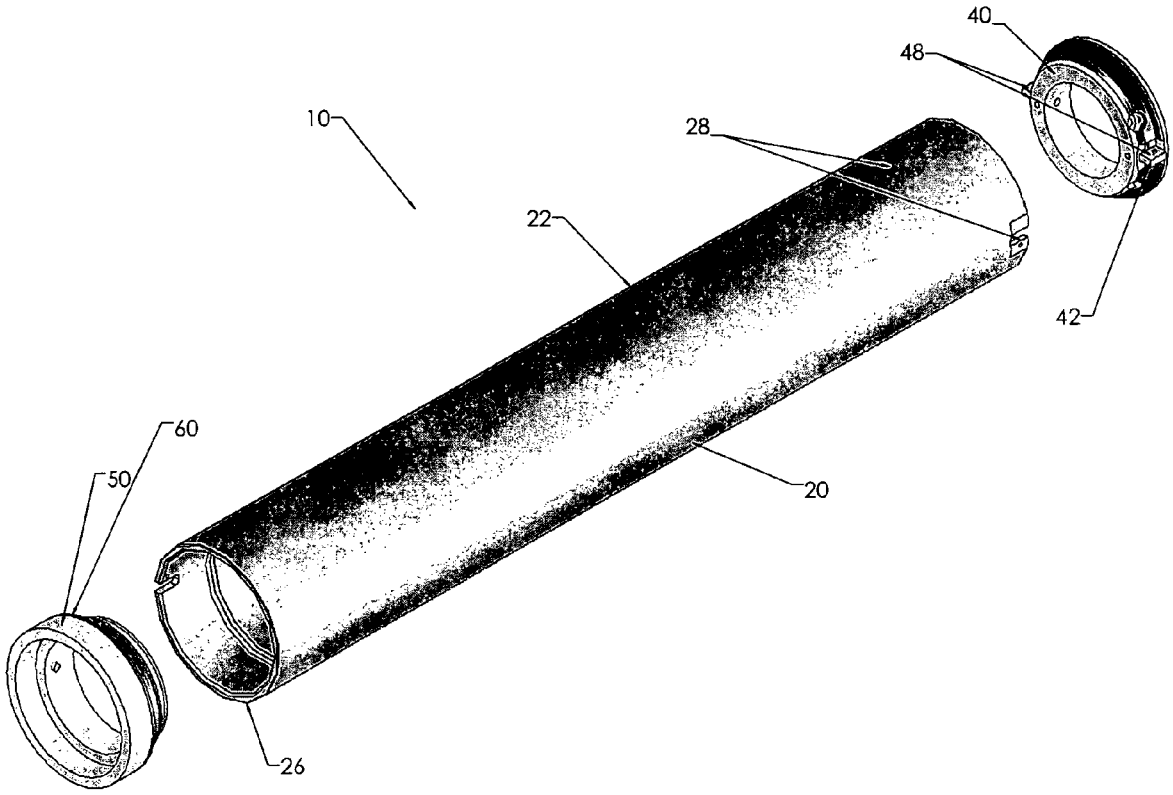
FIG. 2 shows a partially expanded isometric view of the fuser assembly in accordance with the present invention.
Figure 3:
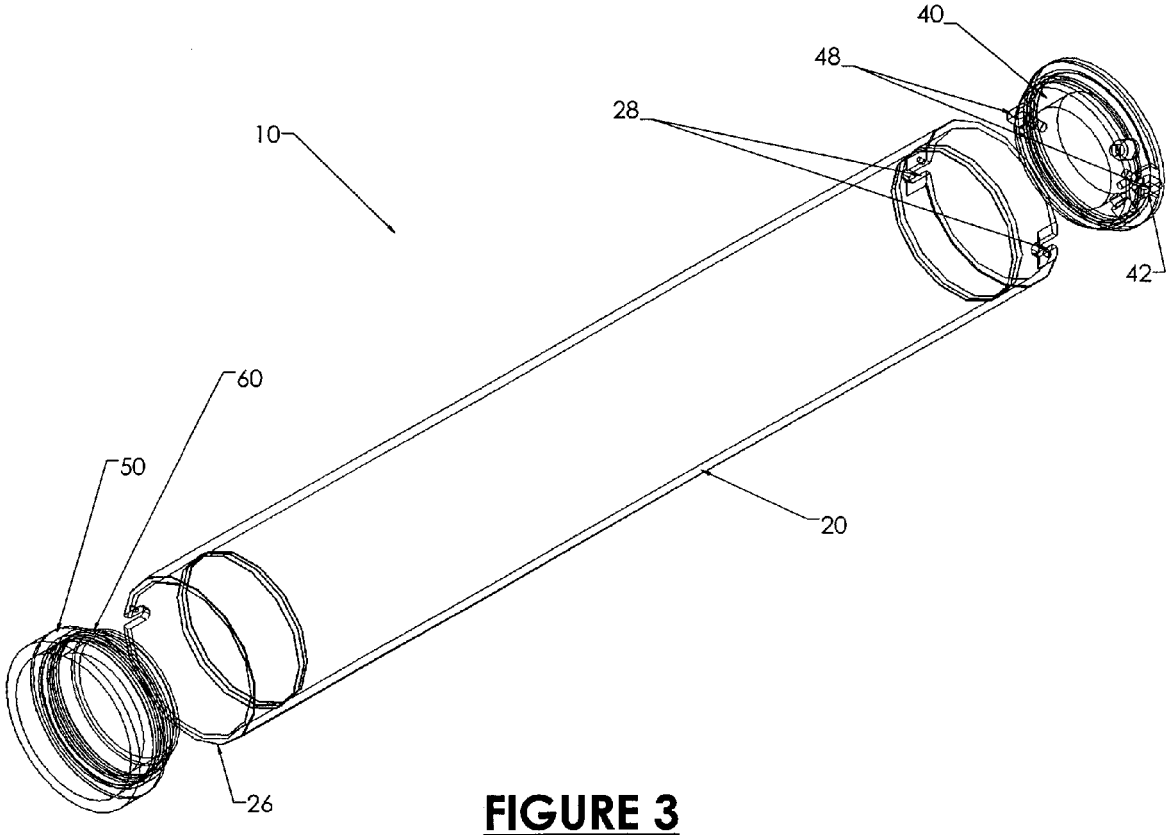
FIG. 3 shows a partially expanded isometric wireframe view of the fuser assembly in accordance with the present invention.

With reference to FIGS. 1–3, and 9, a fuser assembly 10 of the present invention is shown. Assembly 10 includes fuser core 20, a first collar 30, and first hub 40. Fuser core 20 defines an elongated shaft 22 terminating at a first end 24 and a second end 26. Fuser core 20 is typically fabricated from aluminum or another material suitable for transferring heat. A polymer coating (not shown) can be applied to the surface of the core 20 over the shaft 22. Fuser core 20 can be hollow, or solid while remaining within the scope of the invention.

Fuser core 20 mates with hub 40 at end 24. A key slot 28 may be disposed in end 24 to facilitate rotation of core 20. The specific configuration of hub 40 will vary depending upon the specific printer or copier in which it is used. Hub 40 includes at least one key 42. During operation, key 42 is disposed in key slot 28 to provide interference of core 20 against hub 40. Hub 40 may also include aperture 44 to mount hub 40 to an electrophotographic printer or copier. Aperture 46 may also be disposed in hub 40 to facilitate installation. A second hub 50 is configured to mate with end 26 of core 20. The specific configuration of hub 50 will vary depending upon the specific printer or copier in which it is used. Hub 50 may include one or more keys (not shown) to correspond with one or more key slots on end 26.

In accordance with the present invention, collar 30 may be disposed onto hub 40. Similarly collar 60 may be disposed on hub 50. Collar 30 is configured to substantially eliminate or reduce the clearance between the outside diameter of hub 40 and the inside diameter of end 24. Similarly, collar 60 is configured to substantially eliminate or reduce the clearance between the outside diameter of hub 50 and the inside diameter of end 26.

Collars 30 and 60 are fabricated of an elastomeric material. The elastomeric material layer may comprise any thermosetting elastomer, thermoplastic elastomer, polymer alloy, blend or hybrid material capable of continuous operation at temperatures up to 482° F. (250° C.). Suitable examples of the elastomeric material include, but are not limited to, silicone materials, flurosilicone material, fluorocarbon material or any copolymer, terpolymer, or blend of the fore mentioned materials.

In a preferred embodiment the elastomeric material has a low volume swell in the presence of functional and non functional polydimethlsiloxane fluids at the fuser's operating temperature. In an alternative embodiment, the elastomeric material for collars 30 and 60 comprises a fluorocarbon material (FKM) having a hardness between 40 and 95 Shore A.

Collars 30 and 60 may be independently molded and subsequently assembled onto hubs 40 and 60. Alternatively, collars 30 and 60 may be molded directly onto the hub members 40 and 60 using various bonding agents.

Figure 4:
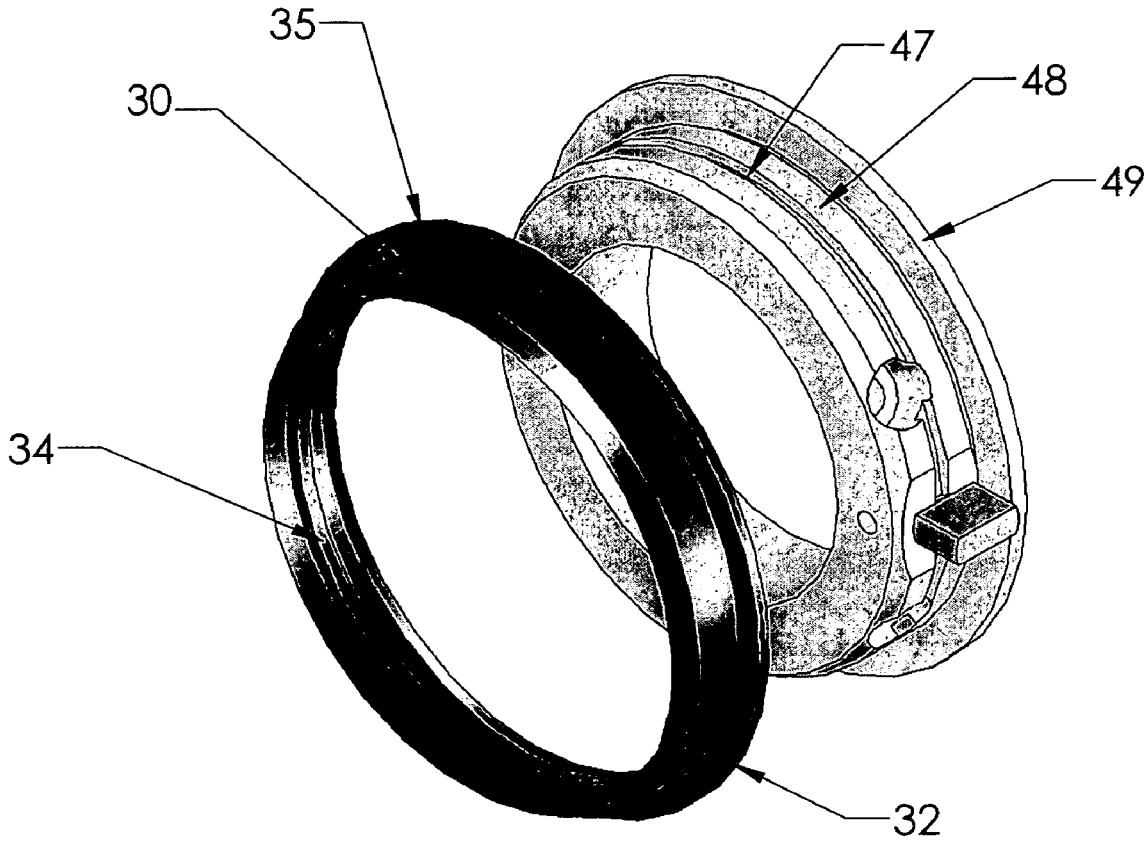
FIG. 4 shows an expanded isometric view of the hub and collar in accordance with the present invention.
Figure 7:
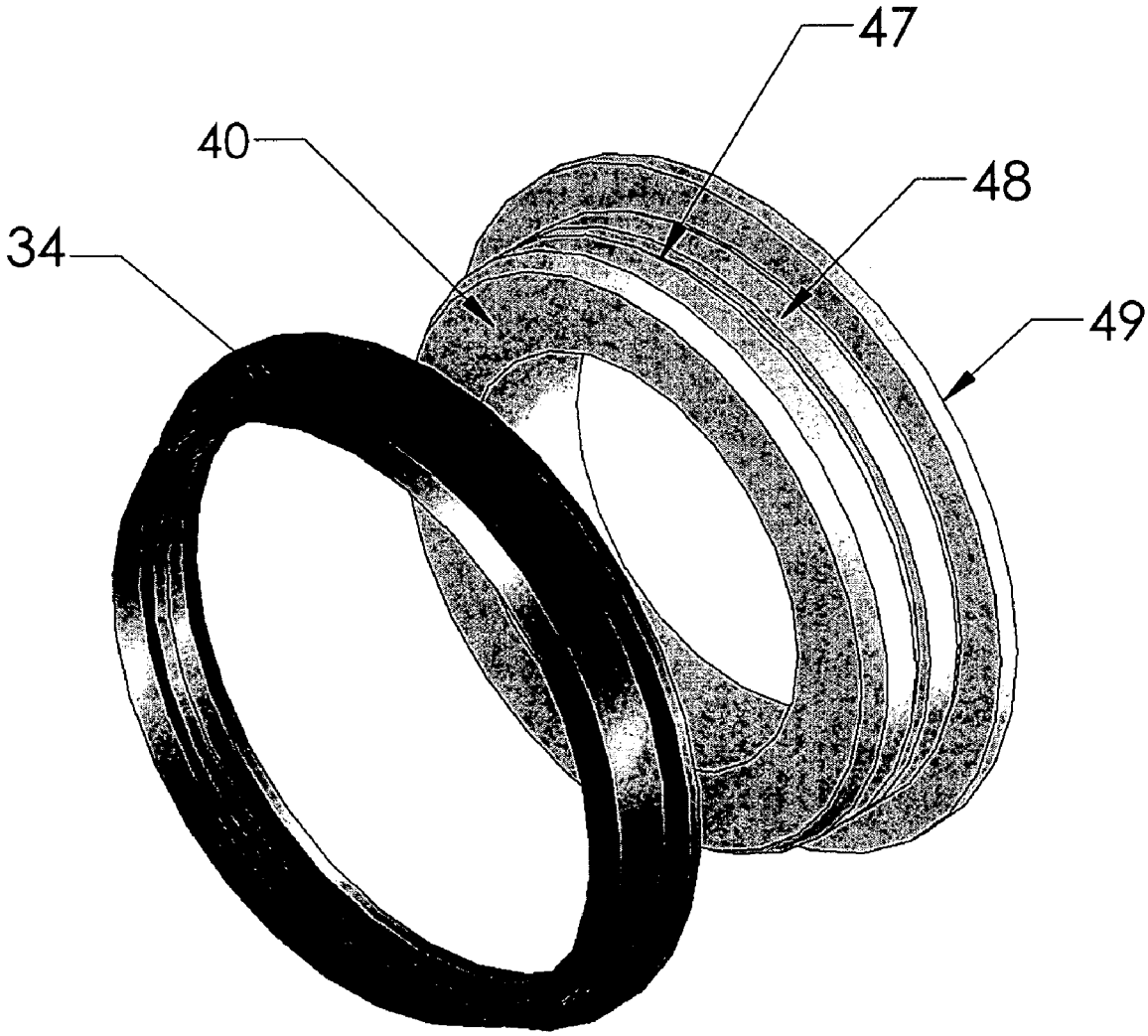
FIG. 7 shows an exploded view of a hub assembly in accordance with the present invention.
Figure 8:
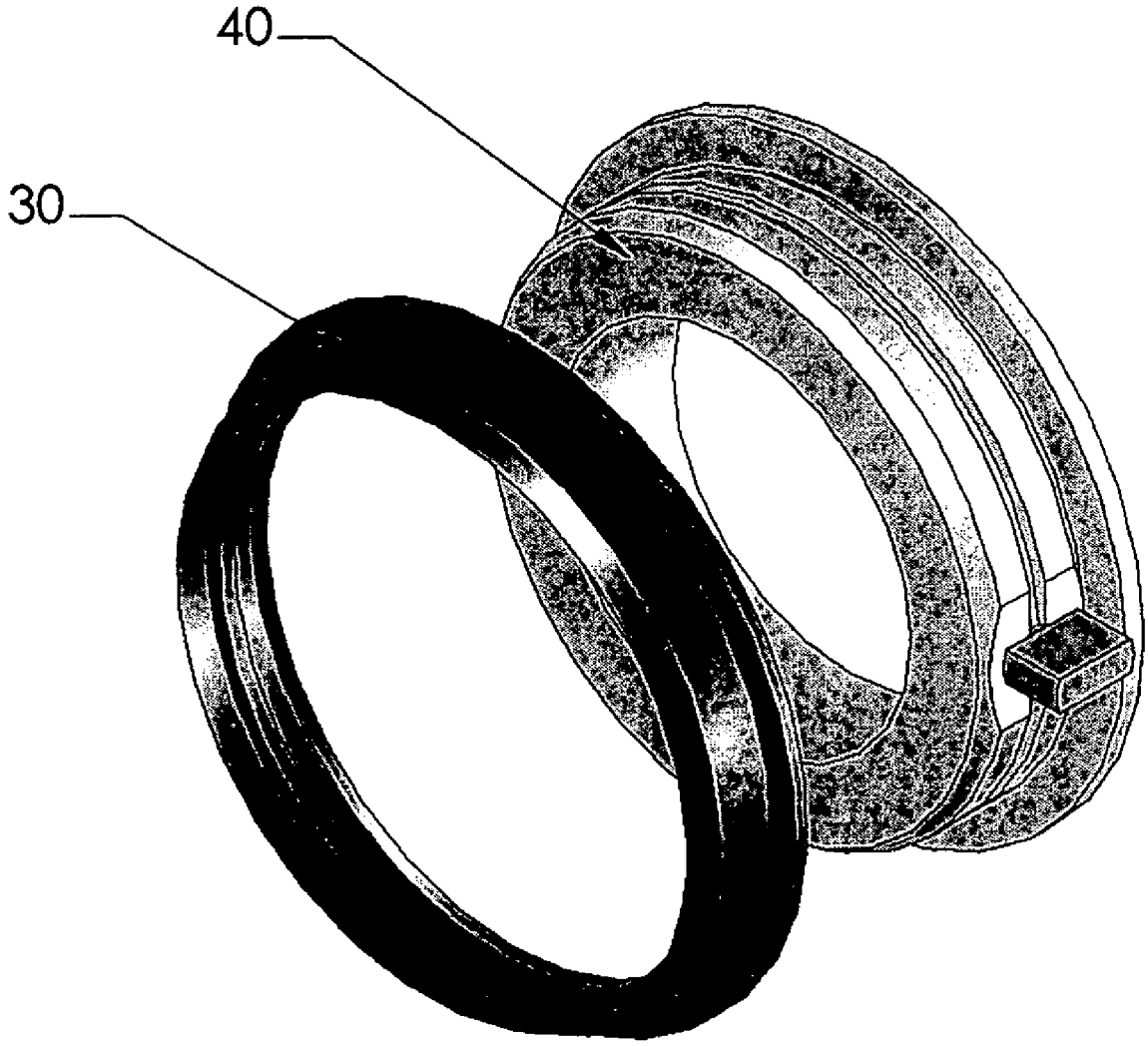
FIG. 8 shows an exploded view of an alternative embodiment of the hub assembly of the present invention.
Figure 9:
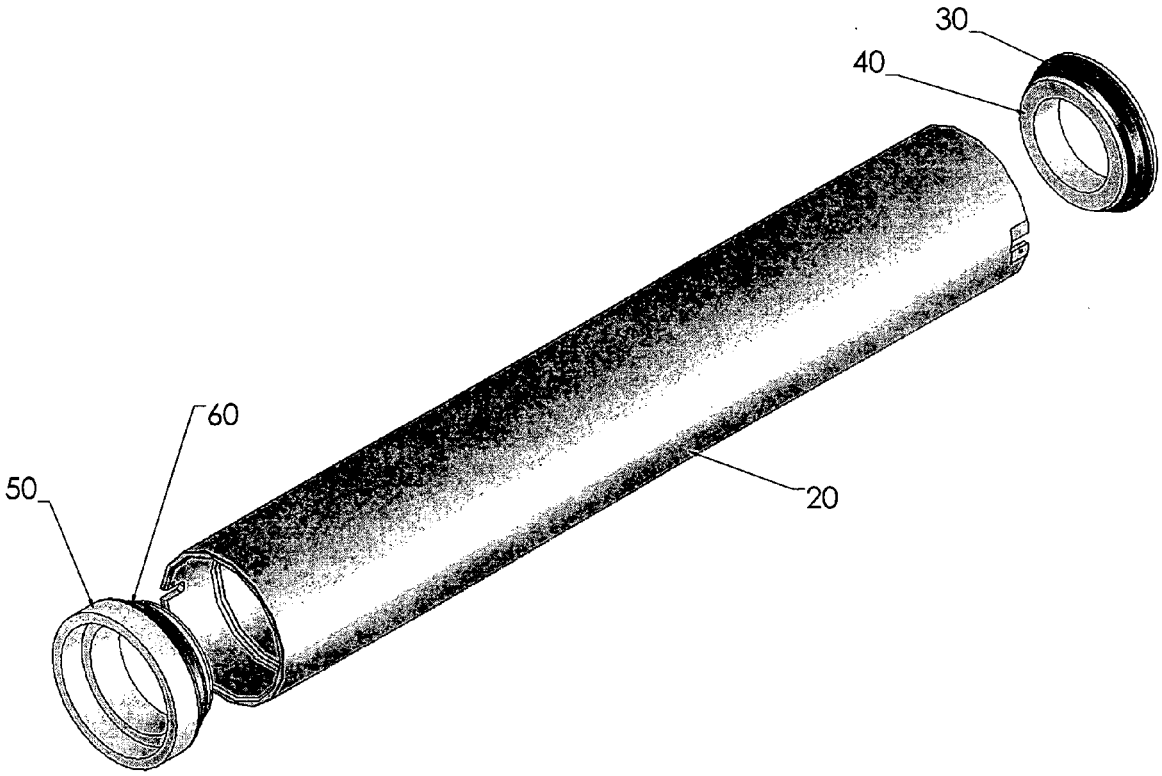
FIG. 9 shows an expanded isometric view of an alternative embodiment of the fuser assembly in accordance with the present invention.

As shown in FIGS. 4, 7, and 8, hub 40 includes body 48 and flange 49. A plurality of grooves are disposed about the exterior periphery of body 48. Flange 49 may extend beyond the periphery of body 48. Similarly, collar 30 includes sleeve 32 and flange 35. The sleeve 32 of collar 30 is configured to be disposed about the outer diameter of body 48 so that flange 35 of collar 30 contacts flange 49 of hub 40.

Figure 5:
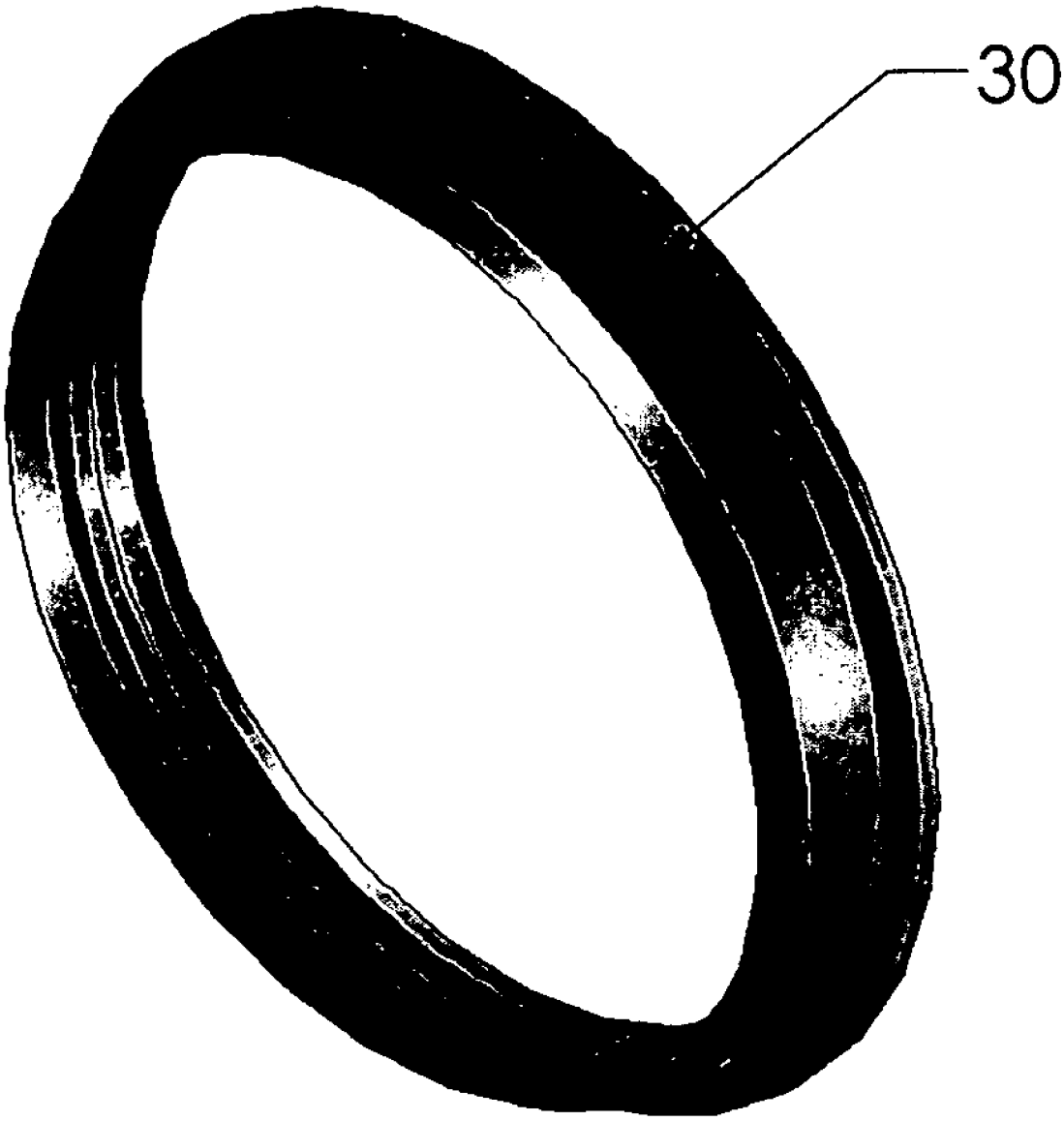
FIG. 5 shows an isometric view of a collar in accordance with the present invention.

Collar 30 is shown with additional detail in FIG. 5. Sleeve 32 of collar 30 has a thickness from the inside diameter of sleeve 32 to the outside diameter of sleeve 32 that is suitable for absorbing any gap between the outside diameter of the hub 40 and the inside diameter of end 24. Similarly collar 60 has a thickness from the inside diameter of sleeve 32 to the outside diameter of sleeve 32 that is suitable for absorbing any gap between the outside diameter of the hub 50 and the end 26. In one embodiment, the thickness of the collars 30 and 60 from the inside diameter to the outside diameter is between 0.01 inches (0.0254 cm) and 0.3 inches (0.635 cm). In another embodiment, the thicknesses of the collars 30 and 60 from the inside diameter to the outside diameter is between 0.05 inches (0.127 cm) and 0.15 inches (0.381 cm), preferably between 0.09 inches (0.2286 cm) and 0.11 inches (0.2794 cm).

Figure 6:
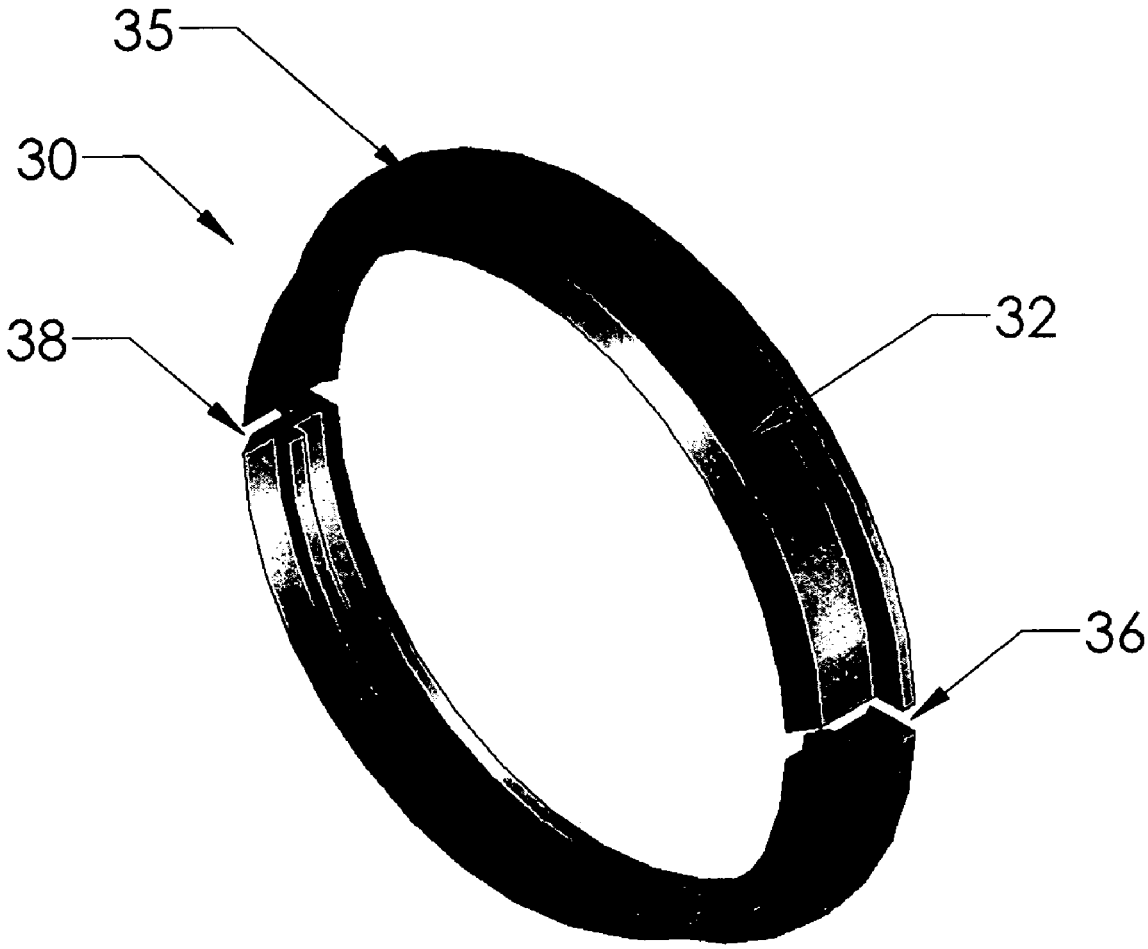
FIG. 6 shows an isometric view of an alternative embodiment of a collar in accordance with the present invention.

An alternative embodiment of collar 30 is shown in FIG. 6. Collar 30 is shown as a multi-piece elastomeric collar that includes apertures 36 and 38. Apertures 36 and 38 may be in the form of holes extending through any one of the sleeve 32, flange 35 or both the sleeve 32 and the flange 35. In yet another embodiment, apertures 36 and 38 may comprise slots extending through both the sleeve 32 and the flange 35. In accordance with the invention, any number of apertures may be disposed in collar 30 while remaining within the scope of the invention.

The FKM used for making collar 30 and collar 60 of the preferred embodiment expands in thickness about 0.004 inches (0.01016 cm) at the operating temperature of 400° F. (204° C.). When the collar 30 is applied to the body 48 of the hub 40, the outer diameter of sleeve 32 of the collar 30 increases by about 0.009 inches (0.02286 cm). The resultant diameter of the hub/collar assembly diameter at operating temperature is similar to the internal diameter of aluminum core 20 at end 24 and end 26. The resulting fit between the core 20 and the hub/collar assembly at operating temperature is optimal, i.e. not too tight or constrained and not too loose.

In one embodiment, the present invention is used with the IBM InfoPrint® 4000 & 4100 printers manufactured by International Business Machines (IBM) of Armonk, N.Y. These high volume printers utilize a hub configuration which includes keys 40 and 42 for drive purposes. This embodiment of the invention, utilizes the keyed steel hubs 40 and 50 with the FKM elastomeric collars 30 and 60 molded onto the hub 40 and 50 respectively. The diameter of the hub/collar assembly is within a range of about 0.001 inch (0.00254 cm) of the inside diameter of core 20 at ends 24 and 26 with which the hub/collar assembly mates. The collars 30 and 60 behave as energy absorbing units when the core 20 and the hubs 40 and 50 go from an operating temperature and speed to a complete stop.

The preferred embodiment of hubs 40 utilizes two drive keys 42 and 48. Drive keys 42 and 48 are located 180° apart. One key 42 engages the drive hub/collar assembly and one key 48 engages the idle hub/collar assembly. The collar 30 is molded in place between the drive keys 42 and 48. A tapered groove 47 is machined on the outer diameter between the keys 42 and 48 to provide an enhanced mechanical bond between the steel hub 40 and the corresponding ring 34 along the interior diameter of collar 30. The elastomeric collar 30 is further secured onto the body 48 of hub 40 by means of a chemical primer that is applied to hub 40 prior to the molding process. The elastomeric collar 30 is molded on the steel hub 40 using a mold designed for the IBM hub consistent with standard molding practices known to the industry. Next, the hub/collar assembly is cured at elevated temperatures as common practice in the industry. Upon cooling, the assembly is ready for installation into the printer and ready for use.

Similarly, collar 60 may be molded onto the sleeve portion 32 of hub 50. A tapered groove is machined on the outer diameter of hub 50 to provide an enhanced mechanical bond between the steel hub 50 and the corresponding ring along the interior diameter of collar 60. The elastomeric collar 60 is further secured onto hub 50 by means of a chemical primer that is applied to hub 50 prior to the molding process. The elastomeric collar 60 is molded on the steel hub 50 using a mold designed for the IBM hub consistent with standard molding practices known to the industry. Upon cooling, the assembly is ready for installation into the printer and ready for use.

In an alternative embodiment, collar 30 may be secured to hub 40 using an adhesive. The adhesive may be applied to the inside diameter of sleeve 32 after collar 30 is molded.

Figure 10:
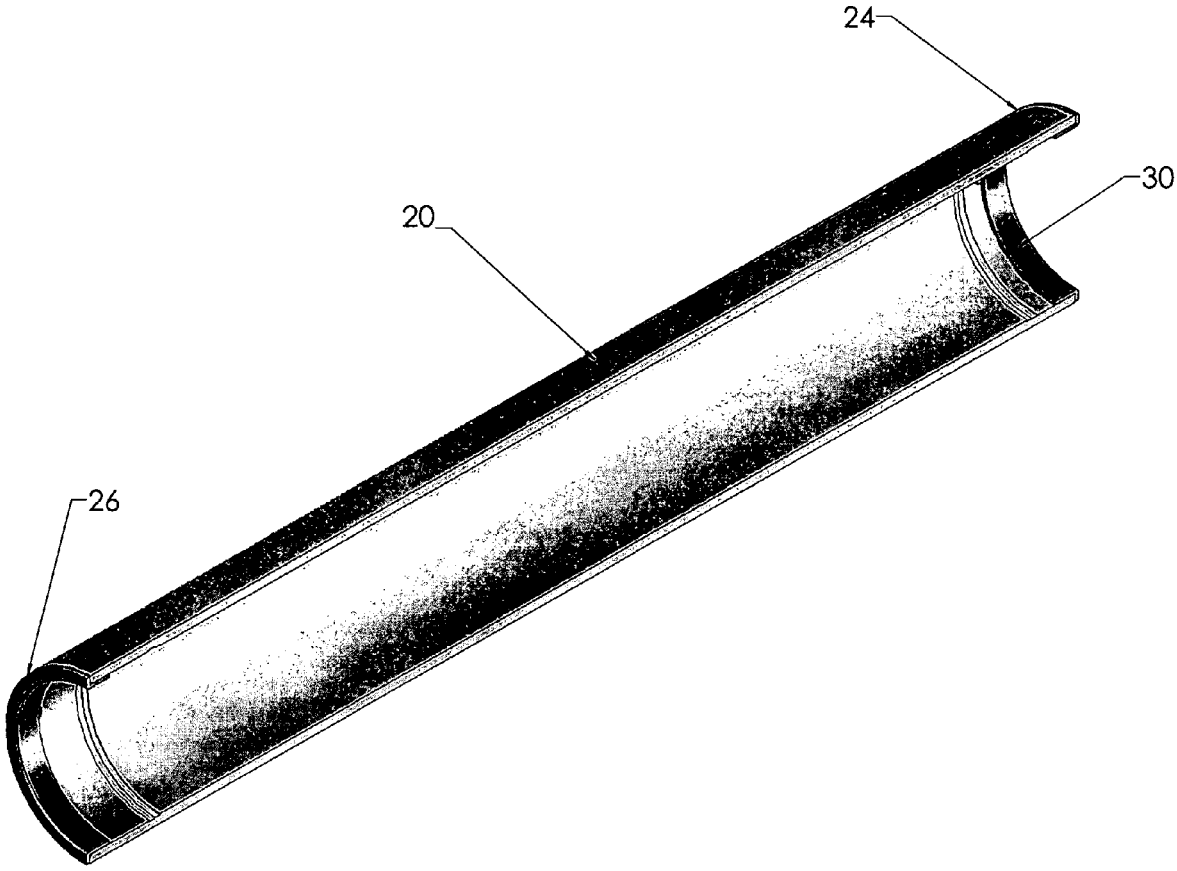
FIG. 10 shows a cross-sectional isometric view of a fuser core with elastomeric collars disposed about the ends of the core.

In yet another alternative embodiment, collar 30 may be located on the inside diameter of fuser core 20 as shown in FIG. 10. Similarly, collar 60 may also be located on the inside diameter of fuser core 20. To provide an enhanced mechanical bond, a tapered ring may be machined on the inside diameter of end 24 and end 26. A chemical primer may also be applied on the inside diameter of end 24 and end 26 before collars 30 and 60 are molded. Upon cooling, the assembly is ready for installation into the printer and ready for use.

In an alternative embodiment, collar 30 may be secured the inside diameter of core 20 using an adhesive. Similarly, collar 60 may be secured to the inside diameter of core 20 using an adhesive.

The preferred embodiment utilizes a fuser core 20 with two drive slots 28 and 29. Drive slots 28 and 29 are located 180° apart, on the drive side 24 of the fuser core 20 to mate with the drive hub 40/collar assembly 30. It will be appreciated, however, that drive slots 28 and 29 are not necessary for the invention.

An alternative example of similar application and design utilizes an Oće Page Stream® printer manufactured by Oc éPrinting Systems GmbH of Poing, Germany. The embodiment of the invention applied to the Oće Page Stream® has the elastomeric member 30 molded to the outer diameter of the steel hub 40 members in the same manor described above. The diameter of the hub 40/collar 30 assembly is within a range of about 0.001 inch (0.00254 cm) of the aluminum fuser roll member inner diameter with which it mates. The present invention may also be applied to a wide variety of other printers and copiers, including devices manufactured by Ricoh Company, Ltd. of Tokyo, Japan, Nexpress Solutions, LLC of Rochester, N.Y., and Canon Kabushiki Kaisha of Tokyo, Japan.

It will be apparent to those skilled in the art that various modifications and variations can be made in the collar assembly apparatus of the invention without departing from the scope or spirit of the invention.

The invention claimed is:

1. An apparatus for stabilizing a fuser in an imaging apparatus, comprising:

a hub having a body, wherein the body comprises an outside diameter configured to be at least partially disposed inside an end of a fuser core;

an elastomeric collar having an inside diameter, wherein the inside diameter is at least partially disposed over the outside diameter of the hub, wherein the collar comprises a sleeve having an inside diameter and an outside diameter, wherein the thickness of the sleeve from the inside diameter to the outside diameter is between 0.01 inches (0.0254 cm) and 0.3 inches (0.635 cm), wherein the hub includes a groove about its outer diameter, wherein the collar comprises a ring on its interior diameter, wherein the ring is at least partially disposed in the collar to create a mechanical bond between the collar and the hub.

2. The apparatus of claim 1, wherein the collar is fabricated from an elastomeric material selected from the group consisting of thermosetting elastomers, thermoplastic elastomers, polymer alloys, blends or hybrid materials capable of continuous operation at temperatures tip to 482° F. (250° C.).

3. The apparatus of claim 2, wherein the hardness of the elastomeric material is between 30 and 95 Shore A.

4. The apparatus of claim 1, wherein the collar is molded onto the hub.

5. The apparatus of claim 4, wherein the collar is secured to the hub using a chemical primer.

6. The apparatus of claim 1, wherein a first key is disposed on the outside diameter of the hub.

7. The apparatus of claim 6, wherein a second key is disposed on the outside diameter of the hub, wherein the first key is spaced apart from the second key.

* * * * *